US011920253B2

(12) United States Patent
Palczewski et al.

(10) Patent No.: US 11,920,253 B2
(45) Date of Patent: Mar. 5, 2024

(54) METHODS OF CONTROLLABLE INTERSTITIAL OXYGEN DOPING IN NIOBIUM

(71) Applicant: JEFFERSON SCIENCE ASSOCIATES, LLC, Newport News, VA (US)

(72) Inventors: Ari D. Palczewski, Westport, CT (US); Eric M. Lechner, Newport News, VA (US); Charles E. Reece, Yorktown, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 0 days.

(21) Appl. No.: 17/735,172

(22) Filed: May 3, 2022

(65) Prior Publication Data

US 2022/0364254 A1 Nov. 17, 2022

Related U.S. Application Data

(60) Provisional application No. 63/189,530, filed on May 17, 2021.

(51) Int. Cl.

| | |
|---|---|
| ***C25D 11/26*** | (2006.01) |
| ***C23C 8/12*** | (2006.01) |
| ***C22F 1/02*** | (2006.01) |
| ***C22F 1/18*** | (2006.01) |

(52) U.S. Cl.

CPC ..... *C25D 11/26* (2013.01); *C22F 1/02* (2013.01); *C22F 1/18* (2013.01); *C23C 8/12* (2013.01)

(58) Field of Classification Search

CPC ... H05H 7/20; H05H 7/18; H01P 7/06; H10N 60/0156; B01J 23/16; H01L 21/38;

(Continued)

(56) References Cited

U.S. PATENT DOCUMENTS

| | | | | |
|---|---|---|---|---|
| 3,671,410 A | | 6/1972 | Stahr | |
| 3,784,452 A | * | 1/1974 | Martens | C25D 11/26 205/322 |

(Continued)

OTHER PUBLICATIONS

Ito, H., Influence of furnace baking on Q-E behavior of superconducting accelerating cavities, Prog. Theor. Exp. Phys., Pub. Online May 6, 2021, p. 1-8, 071G01.

(Continued)

*Primary Examiner* — Ricardo D Morales

(57) ABSTRACT

A method for vacuum heat treating Nb, such as is used in superconducting radio frequency cavities, to engineer the interstitial oxygen profile with depth into the surface to conveniently optimize the low-temperature rf surface resistance of the material. An example application is heating of 1.3 GHz accelerating structures between 250-400° C. to achieve a very high quality factor of $5\times10^{10}$ at 2.0 K. With data supplied by secondary ion mass spectrometry measurements, application of oxide decomposition and oxygen diffusion theory was applied to quantify previously unknown parameters crucial in achieving the oxygen alloy concentration profiles required to optimize the rf surface resistance. RF measurements of vacuum heat treated Nb superconducting radio frequency cavities confirmed the minimized surface resistance (higher $Q_0$) previously expected only from 800° C. diffusive alloying with nitrogen.

1 Claim, 4 Drawing Sheets

(58) Field of Classification Search
CPC ... H01L 21/385; H01L 21/465; H01L 21/469; H01L 21/473; H01L 21/47576
See application file for complete search history.

(56) References Cited

U.S. PATENT DOCUMENTS

| | | | | |
|---|---|---|---|---|
| 3,902,975 | A * | 9/1975 | Martens | H05H 7/20 205/148 |
| 2012/0172648 | A1 | 5/2012 | Posen | |
| 2014/0285952 | A1 | 9/2014 | Starck | |
| 2020/0113039 | A1 * | 4/2020 | Posen | H05H 7/20 |

OTHER PUBLICATIONS

Ciovati, G.,Improved oxygen diffusion model to explain the effect of low-temperature baking on high field . . . , Appl. Phys. Lett. 89-022, Pub. Online, Jul. 13, 2006, p. 1-3.
Posen, S, Ultralow Surface Resistance via Vacuum Heat Treatment of Superconduct . . . , Physical Review Applied 13, 014024, American Physical Society, Pub. Jan. 14, 2020. p. 1-10.
Posen et al., Posen et al. (2020). 'Ultralow Surface Resistance via Vacuum Heat Treatment of Superconducting Radio-Frequency Cavities', Physical Review Applied., Jan. 14, 2020, pp. 014024-1-10.
Semione et al., "Niobium near-surface composition during nitrogen infusion relevant for superconducting radio-frequency cavities", Physical Review Accelerators and Beams (2019), p. DOI:10.1103/PHYSREVACCELBEAMS.22. pp. 103102-1-9.
Delheusey et al. Delheusy et al. (2008). 'X-ray investigation of subsurface interstitial oxygen at Nb/oxide interfaces'. Applied Physics Letters. 92. pp. 101911-1-1-3.

* cited by examiner

METHODS OF CONTROLLABLE INTERSTITIAL OXYGEN DOPING IN NIOBIUM

This application claims the benefit of Provisional Application No. 63/189,530, filed May 17, 2021. U.S. 63/189,530 is incorporated herein by reference in its entirety.

United States Government may have certain rights to this invention under Management and Operating Contract No. DE-AC05-06OR23177 from the Department of Energy.

FIELD OF THE INVENTION

The invention relates to SRF (superconducting radio frequency) technology, and more particularly to a method for thermal diffusion of interstitial atomic species into the surface of niobium SRF accelerator cavities to increase the quality factor ($Q_0$) of the cavities.

BACKGROUND OF THE INVENTION

Although the thermal diffusion of nitrogen into the surface of niobium SRF accelerator cavities (often referred to as nitrogen doping) has been shown to increase the quality factor ($Q_0$) of SRF accelerator cavities, the method involves several time-consuming surface preparation steps and requires a high-temperature vacuum furnace (800° C.) and one or more surface layer removal steps involving active wet chemistry.

Accordingly, it is desirable to increase the quality of SRF accelerator cavities by techniques requiring fewer surface preparation steps, less-expensive heating facilities, and without the need for surface layer removal such as is required with the nitrogen doping method.

BRIEF DESCRIPTION OF THE SEVERAL VIEWS OF THE DRAWING(S)

Reference is made herein to the accompanying drawings, which are not necessarily drawn to scale, and wherein:

FIG. 1*a* is a depth profile plot depicting the realization of quality-factor-enhancing interstitial oxygen concentration into niobium samples as a function of depth into the surface as measured by secondary ion mass spectrometry (SIMS) for two process cases: heating at 300° C. for 2.3 hours, and 350° C. for 2.7 hours.

FIG. 1*b* depicts the oxygen concentration profile for four process cases: heating at 240° C. for 0.9 hours, 220° C. for 19.7 hours, 280° C. for 3.0 hours, and 330° C. for 0.5 hours.

FIG. 1*c* depicts the oxygen concentration profile for two additional process cases: 140° C. for 12.3 hours and 140° C. for 48.3 hours.

FIG. 2 is a SIMS oxygen concentration depth profile where the sample was made using only the oxygen in the naturally-occurring oxide on the niobium surface. The co-monitored nitrogen content also displayed is consistent with typical concentration in standard bulk niobium. The heating process case was 300° C. for 2.3 hours.

BRIEF SUMMARY OF THE INVENTION

Figure 1A:
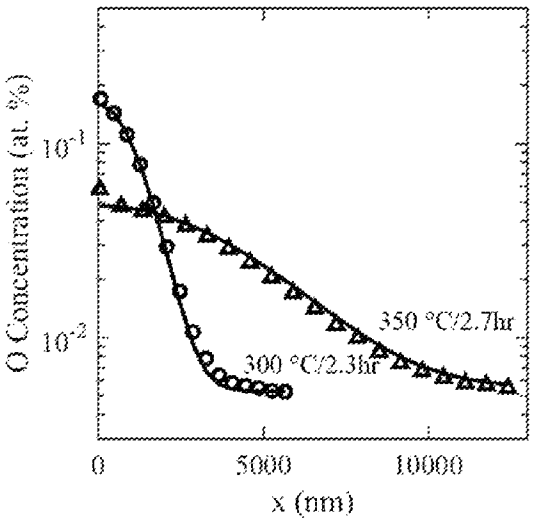

Nb superconducting radio frequency cavities vacuum heat treated between 300-400° C. for a few hours have exhibited very high quality factors (~$5\times10^{10}$ at 2.0 K). Secondary ion mass spectrometry measurements of O, N and C show this enhancement in RF surface conductivity is primarily associated with interstitial O alloying via dissolution and diffusion of the native oxide. We use a theory of oxide decomposition and O diffusion to quantify previously unknown parameters crucial in modeling this process. RF measurements of a vacuum heat treated Nb superconducting radio frequency cavity confirm the minimized surface resistance (higher $Q_0$) previously expected only from 800° C. diffusive alloying with N.

DETAILED DESCRIPTION OF THE INVENTION

Superconducting radio frequency (SRF) technology is and will be an enabling technology for current and future major particle accelerators used to facilitate fundamental scientific inquiries. Its employment is due to extreme efficiency and ability to operate in high duty cycle or continuous wave modes. Efforts to increase the efficiency of Nb SRF resonant cavities via interstitial alloying with nitrogen, titanium, or other impurities have yielded a significant reduction of the surface resistance, $R_s$, by a factor of 2-4. Performance enhancement in interstitially alloyed cavities is inherently a complex multifaceted problem. In this space, the performance is dependent on the interplay between electron mean free path, enhanced sensitivity to trapped flux, a normal-conducting hydride precipitate blocking effect, and density of states tuning. With interstitial alloying, these factors have often worked in concert to produce resonant cavities with unprecedented low surface resistance (high quality factor), but often with lower maximum supportable field amplitude.

In the range of 300° C. to 400° C., the cavities exhibited pronounced decrease of $R_s$ with field, extremely high quality factors, and reduced quench fields, all typical qualities previously associated with nitrogen-alloyed Nb cavities. Qualitatively, these effects were assumed to be due to oxygen diffusion from the native Nb oxide. Ito's work is strikingly similar to the work done at Fermi National Accelerator Laboratory (FNAL), where cavities were vacuum heat-treated, in some cases exposed to nitrogen, and RF tested without exposure to atmosphere. Initial time-of-flight secondary ion mass spectrometry (TOF-SIMS) measurements by FNAL observed $Nb_2O_5$ dissolution and a qualitative increase in nitrogen concentration near the surface ~10 nm deep. From these observations it was assumed that nitrogen was the primary alloying diffusant.

Early works in vacuum heat treating Nb SRF cavities in the temperature range of 250° C. to 300° C. showed that the native oxide layer dissolved and a reduced BCS surface resistance, $R_{BCS}$, was measured, likely due to tuning the electron mean free path by oxide dissolution and oxygen diffusion. In these studies, the residual resistance increased, washing out any benefit of $R_{BCS}$ reduction. Later experiments showed that baking cavities around 100° C. improved performance. A one-dimensional oxide dissolution and oxygen diffusion model describing the migration of oxygen into the surface during a 120° C. bake was developed. (The one-dimensional character of the model assumes that there is no lateral variability of the diffusion properties.) However, some dissolution and diffusion parameters in that model were too unconstrained for predictive O concentration diffusion during higher temperature vacuum heat treatments.

In the current invention, unexpected results, including higher quality factors, were obtained by increasing the interstitial oxygen in the surface of an article of niobium and using secondary ion mass spectrometry to measure vacuum heat treated Nb samples to quantify the O, N, and C impurity concentration depth profiles. The O concentration profiles were analyzed using an oxide dissolution and oxygen diffusion model to quantify previously unknown parameters related to oxide dissolution into the bulk.

Samples were cut from Tokyo Denkai ASTM 6 Nb stock procured using the XFEL/007 specification. The stock was first vacuum annealed at 900° C. to promote grain growth following the same procedure as the 1.3 GHz single-cell cavity, SC-16, used for RF validation below. Each sample was nano-polished (NP) to a surface roughness, $R_a$, of ~2 nm to provide sufficiently flat samples for SIMS measurements. Post NP, the samples received a 600° C./10 hr heat-treatment to remove bulk hydrogen caused by the mechanical polishing, followed by a 20 μm electropolish with the typical $HF/H_2SO_4$ solution at 13° C. During each heat treatment, the samples were housed in a double-walled Nb foil container to minimize any furnace contamination. Samples were baked for various times and temperatures, shown in table I, to explore the parameter space of the oxide dissolution and oxygen diffusion processes.

TABLE I

Vacuum heat treatment temperature and duration for samples examined by SIMS.

| Sample | Temperature (° C.) | Time (hr) |
|---|---|---|
| NL409 | 300 | 2.3 |
| NL411 | 350 | 2.7 |
| NL431 | 140 | 48.3 |
| NL438 | 280 | 3.0 |
| NL439 | 240 | 0.9 |
| NL440 | 300 | 2.6 |
| NL447 | 140 | 12.3 |
| NL448 | 330 | 0.5 |
| NL449 | 220 | 20 |

SIMS measurements were made using a CAMECA 7f Geo magnetic sector SIMS instrument. The primary ion beam is comprised of $Cs^+$ using an accelerating potential of 5 kV and sample potential of −3 kV for an impact energy of 8 keV. This ion beam is rastered over an area of 150 μm×150 μm and the data collected from a 63 μm×63 μm area in the center of the larger raster. Proper quantitation of SIMS depth profiles requires the use of implant standards in order to convert the ion signal to impurity concentration. Here we used implant standards to quantify the O, C and N composition of RF penetration layer and beyond by detecting $^{16}O^-$, $^{12}C^-$ and $^{107}(NbN)^-$ secondary ions in conjunction with a $^{93}Nb^-$ reference signal. The implant standards used in these SIMS experiments were dosed with C, N and O at $2\times10^{15}$ atoms/cm$^2$ at 135 keV, 160 keV and 180 keV, respectively by Leonard Kroko Inc. SIMS depth profiles were acquired to the background O, N and C levels for all samples.

An oxygen concentration profile of the niobium surface was then developed from the oxygen dissolution and diffusion model.

The thermal dissociation rate constant, $k_X$, of surface oxide component X, on niobium (principally $Nb_2O_5$) follows the Arrhenius equation according to:

$$k_X(T) = A_X e^{-E_{ak_X}/RT}$$

where $A_X$ is the "frequency factor" which quantifies the frequency of oxide dissolution, $E_{ak_X}$ is the activation energy for the dissociation reaction, R is the universal gas constant, and T is temperature.

The one-dimensional thermal diffusion of oxygen interstitially within the niobium crystalline lattice is described b the function:

$$\frac{\partial c(x,t)}{\partial t} = D(T(t))\frac{\partial c(x,t)}{\partial x^2} + \sum q_X(x,t,T)$$

using a point like source at the surface, $q_X(x, t, T)=u_X\delta(x)$ and an initial interstitial oxygen content $c(x=0, t=0)=v\ \delta(x)$ $$D(T)=D_0e^{-E_{aD}/RT}$$

where c is the concentration of oxygen, x is the position from the surface towards the bulk, and t is time, D is the diffusion rate coefficient, $D_0$ is the high temperature diffusion coefficient, $E_{aD}$ is the activation energy for diffusion, and $q_X$ is the diffusion equation source term representing the decomposition of oxide component X. $u_X$ and v quantify the oxygen concentration available from oxide component X and initial interstitial oxygen concentration respectively.

Figure 1B:
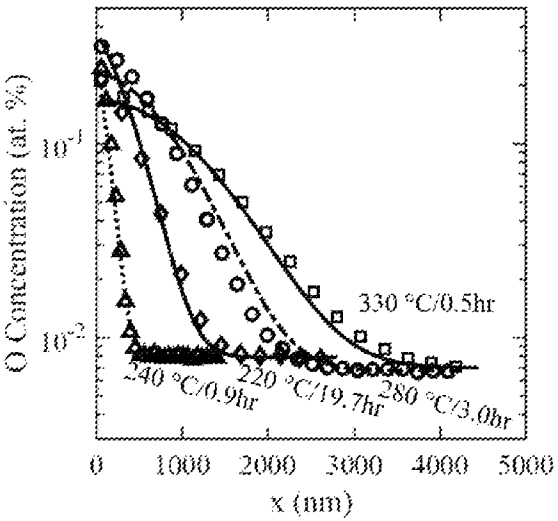
Figure 1C:
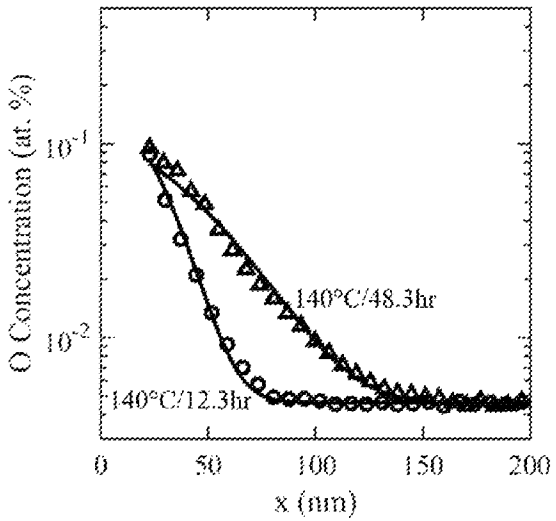

FIGS. 1*a*, 1*b*, and 1*c* are depth profile plots depicting the realization of quality-factor-enhancing interstitial oxygen concentration into niobium samples as a function of depth into the surface as measured by secondary ion mass spectrometry (SIMS) for eight different cases. Plotted together with the data is the parametrized characterization of the process corresponding to the specific heating protocol used in each instance.

FIG. 1*a* depicts the oxygen concentration profile for two process cases: heating at 300° C. for 2.3 hours, and 350° C. for 2.7 hours.

FIG. 1*b* depicts the oxygen concentration profile for four process cases: heating at 240° C. for 0.9 hours, 220° C. for 19.7 hours, 280° C. for 3.0 hours, and 330° C. for 0.5 hours.

FIG. 1*c* depicts the oxygen concentration profile for two additional process cases: 140° C. for 12.3 hours and 140° C. for 48.3 hours The excellent agreement between data and parametric characterization demonstrates predictability and thus the ability to create a desired oxygen concentration profile with depth into the surface of the niobium. By variation of time and temperature profile of vacuum heating of niobium, and fitting the resultant experimental SIMS data (reference FIGS. 1*a*, 1*b*, and 1*c*), we determine the values of the dissociation and diffusion parameters of native surface oxide to be.

$A_X=0.9\pm0.6\times10^9$1/s, $E_{ak_X}=131\pm0.3$ kj/mol, $D_0=0.075\pm0.005$ cm$^2$/s, $E_{aD}=119.9\pm0.3$ kJ/mol, $u_X=200\pm2$ O at. % nm, $v=3.5\pm0.1$ O at. % nm With such a parametrized model of niobium oxide dissociation and diffusion, one may tailor production methods to obtain a desired interstitial oxygen concentration profile into the surface.

The present invention is a method for producing tailored-concentration profiles of interstitial oxygen alloying of niobium (Nb) into the surface. Here, by "tailored", we mean obtaining an intentional concentration profile with depth into the surface. The method allows for increased quality factors in superconducting radiofrequency cavities (reduced surface resistance) with fewer surface preparation steps and without the need for surface layer removal such as with nitrogen doping.

Controllable physical and electronic property modifications are also relevant for other niobium devices e.g., quantum computing devices and superconducting antennae.

This method uses oxygen sources in niobium oxide (native or anodized) or additional gaseous forms to precisely control the level of interstitial oxygen in the surface material of niobium devices without the need for post-process chemical treatments apart from possibly nanometer level contamination removal.

A first embodiment in this method is the controlled vacuum annealing of typically-prepared niobium. This annealing is designed to dissociate portions of the surface oxide and to thermally diffuse this liberated oxygen into the surface.

A second embodiment provides controlled anodization of the niobium surface prior to tailored time/temperature vacuum annealing. This pathway method enables increasing the available oxygen source term in a precise way.

A third embodiment reduces the native oxide by heating above ~400° C., absorbing most of the oxygen into the bulk, and then at a lower controlled temperature introduces pure oxygen gas into the vacuum for absorption into the niobium surface.

Given the nature of native niobium oxide diffusion, changing the interstitial oxygen in niobium via thermal dissociation and diffusion of the native oxide can also be performed in a non-oxide dissolution liquid such as water under pressure or oil, rather than within a vacuum environment. This constitutes a fourth embodiment to implement the method of this invention.

The use of this technique can be tested by performing a calibrated SIMS depth profiling measurement on a cutout from a part or cavity or similarly suitable sample to characterize the oxygen concentration profile within the top few microns.

A typical sequence of process steps for this invention method includes:

1) Prepare surface oxide (implied~4 nm surface native oxide).
   a. Option 1 via the first embodiment, no additional O source (native oxide only); and
   b. Option 2 via the second embodiment, anodized niobium surface to provide controlled additional thickness of surface pentoxide which increases and specifies the oxygen source.
2) Vacuum heat treatment with prescribed time/temperature profile preferably in the range 120 to 420° C. with durations at various temperatures ranging from a few minutes to tens of hours. to enable dissociation of surface pentoxide and diffusion of oxygen into the surface niobium matrix, with option of providing additional oxygen source via provided gaseous environment. (An example implementation useful to SRF cavities would be constant temperature in the range 280 to 330 C for times of 0.5 to 3.0 hours.) The process temperature need not be constant.
   a. Option 1—no additional O source; and
   b. Option 2—controlled gaseous oxygen supply during a specified portion of the time/temperature profile to present additional oxygen for diffusion into the surface.
3) From the vacuum state, engineer the top finished surface.
   a. Option 1—exposure to typical room atmosphere, re-growing native surface oxide
   b. Option 2—exposure to controlled dry $O_2$ source, growing controlled surface oxide
   c. Option 3—deposition of a capping material for the purpose of preserving or modifying the surface structure for tailored superconducting properties.

The typical sequence of process steps may be repeated with different temperature and time parameters to realize deliberate tailored structure in the oxygen concentration profile into the surface of the niobium.

The product is an engineered surface with an interstitial oxygen concentration profile into the Nb surface having highly desirable surface resistance properties when cooled to cryogenic temperatures. These desirable qualities in some circumstances have been shown to occur with O concentrations on the order of 1000 atomic parts per million as shown in the SIMS depth profiles in FIGS. 1-4.

FIGS. 1*a*, 1*b*, and 1*c* are depth profile plots depicting the realization of quality-factor-enhancing interstitial oxygen concentration into niobium samples as a function of depth into the surface as measured by secondary ion mass spectrometry (SIMS) for eight different cases. Plotted together with the data is the parametrized characterization of the process corresponding to the specific heating protocol used in each instance.

The excellent agreement between data and parametric characterization demonstrates predictability and an ability to create a desired oxygen concentration profile in the surface of the niobium.

Figure 2:
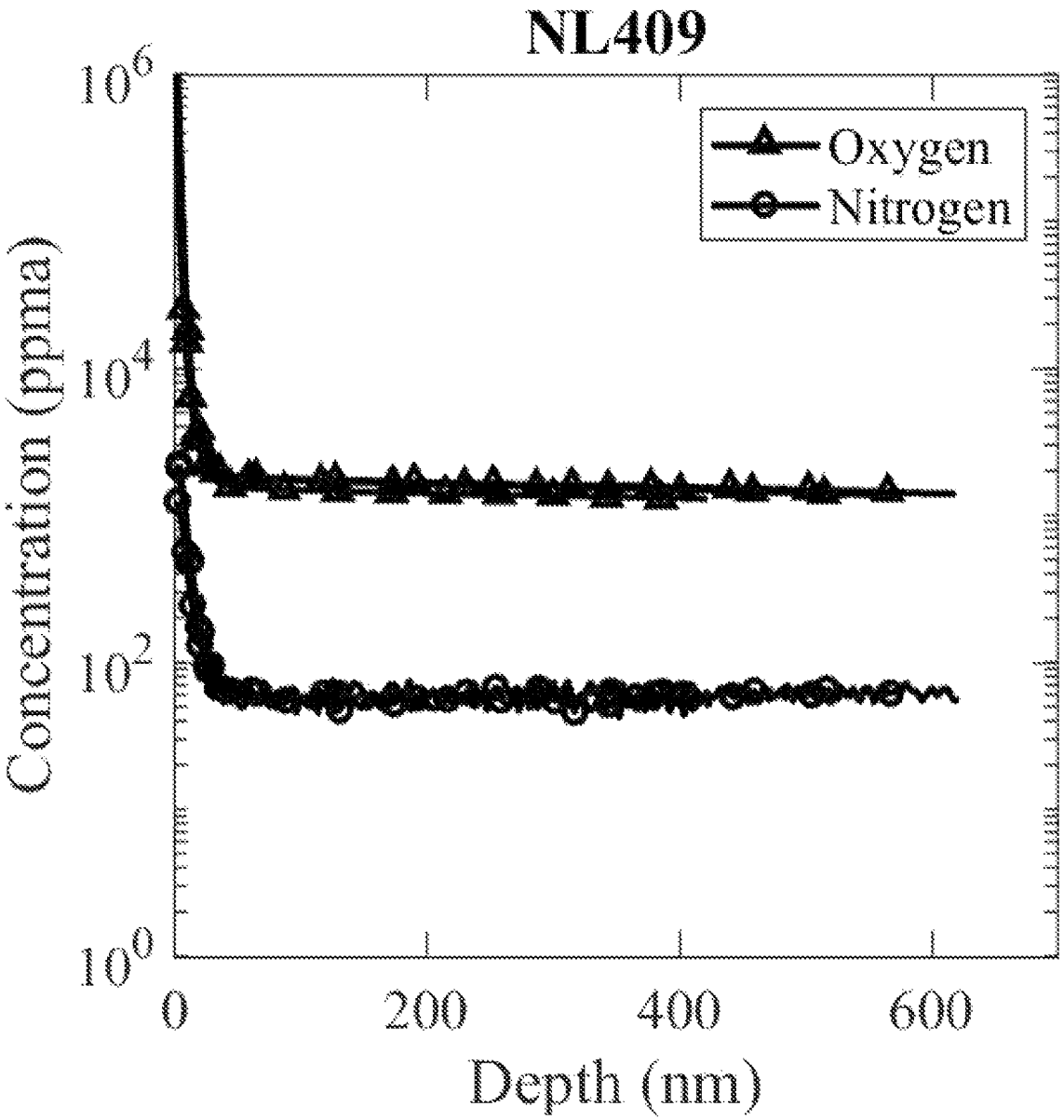

Referring to FIG. 2, a first SIMS oxygen depth profile where the sample was made using no additional O source option. The heating process case was 300° C. for 2.3 hours. The co-monitored nitrogen content also displayed is consistent with typical concentration in standard bulk niobium.

Figure 3:
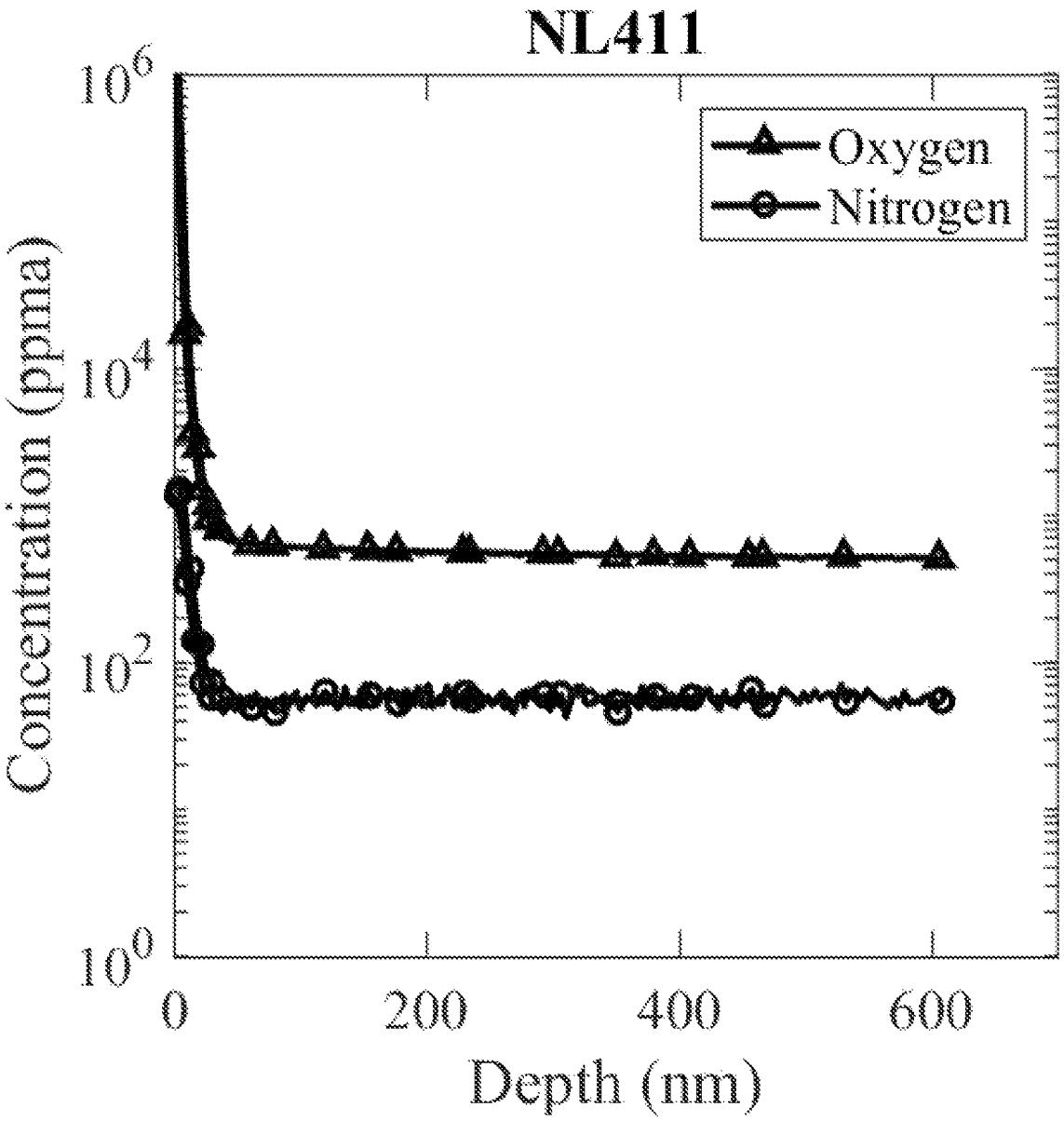
FIG. 3 is a second SIMS oxygen depth profile in which the sample was made using no additional O source, with a different time and temperature process to that of FIG. 2. The heating process case was 350° C. for 2.7 hours.

Referring to FIG. 3, the sample was made using no additional O source option, but with a different a time and temperature protocol. The heating process case was 350° C. for 2.7 hours.

Figure 4:
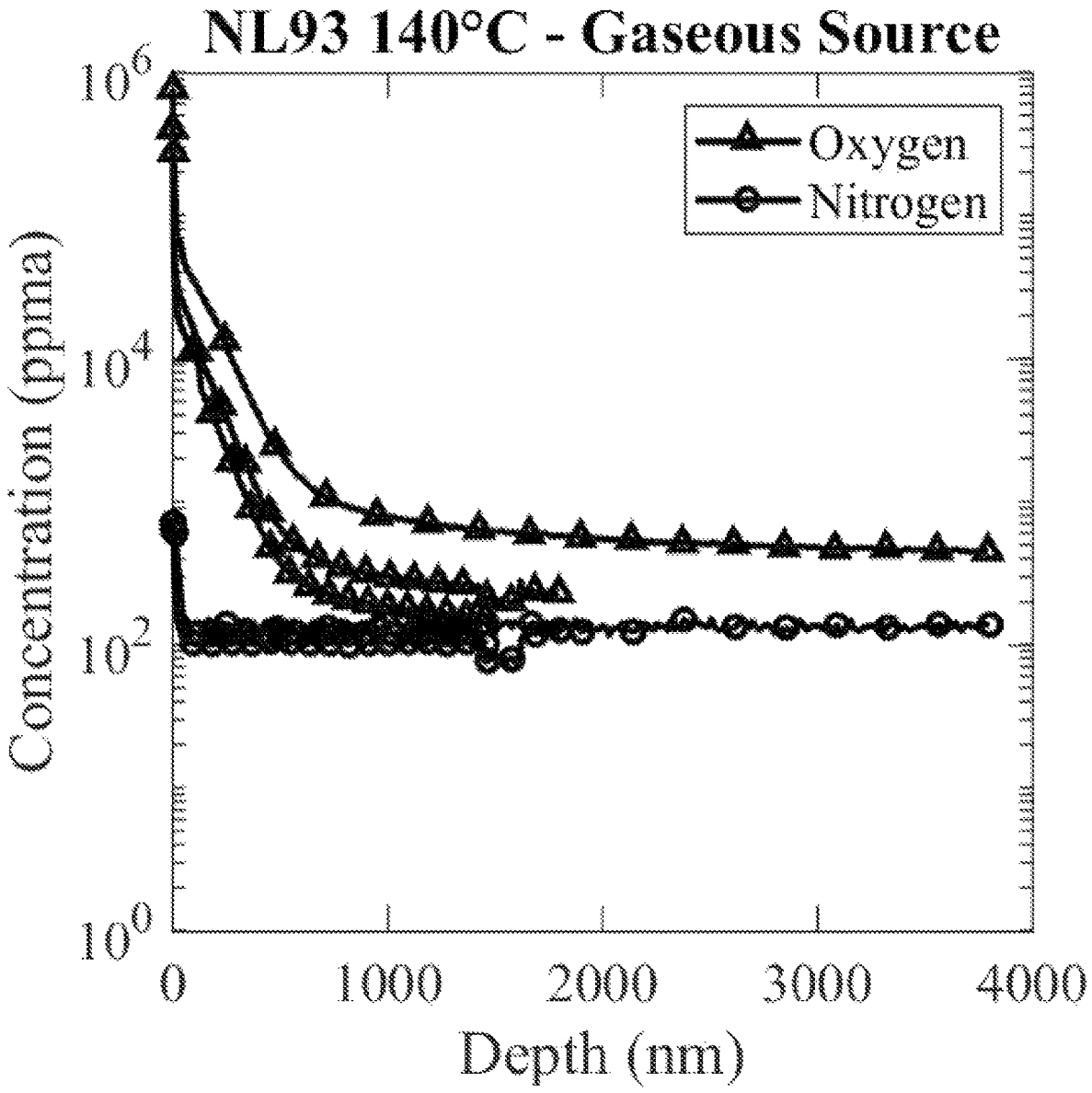
FIG. 4 is a SIMS oxygen depth profile where the sample was made using the addition of a gaseous oxygen source during the heating.

Similarly, using the addition of a gaseous oxygen source during heating as was done for the sample depicted in FIG. 4, one can tune the magnitude of the O concentration as shown in the SIMS depth profiles presented in FIGS. 2-3. The decay of O concentration into the bulk can be tuned by the time and temperature as shown in all three figures.

Known competing technologies include interstitial nitrogen doping, which requires high temperatures of ~800° C., very clean furnaces, and post treatment chemistry, particularly electropolishing, to achieve high quality factors and gradients. These factors make the oxygen diffusion process described here more feasible for widespread economical use as compared with nitrogen doping for devices.

The beneficial effects of nitrogen doping on SRF cavities are currently limited to elliptical-shaped cavities because of removal uniformity challenges of the final electropolishing step to remove the deleterious surface nitrides, whereas the use of oxygen is inherently geometry independent, resulting in a highly desirable conformal surface characteristic.

Current markets and customers include SRF cavity manufacturing, SRF cavity manufacturing and surface-sensitive refractory metals processing that require heat treatment. Research Instruments in Germany, SIMIC in Italy, Niowave Roark in US, KEK and Mitsubishi heavy industries in Japan, Institute of High Energy Physics (IHEP) and Orient Tantalum Industry Co. Ltd (OTIC), Ningxia.

Future markets and customers include future and contemporary superconducting niobium accelerators, furnace annealed refractory metals that are surface sensitive, superconducting high directivity antennae, and niobium devices for quantum computing.

There appear to be no limitations of the invention as modeling shows the surface oxygen can be tailored by these methods to almost any beneficial interstitial percentage as a function of depth into the surface.

The invention claimed is:

1. A method for increasing the interstitial oxygen as a function of depth into the surface of an article of niobium (Nb), comprising:

preparation of a surface oxide on the surface of the article of niobium;

vacuum heat treating at a constant temperature of 280 to 330° C. for 0.5 to 3 hours to dissociate the surface oxide and diffuse oxygen into the surface niobium matrix;

regrowing a surface oxide by exposing the Nb cavity to room atmosphere; and regrowing the surface oxide until a secondary ion mass spectrometry (SIMS) depth profile verifies the O concentration of the article of niobium is at least 1000 atomic parts per million.

* * * * *